US007654634B2

(12) United States Patent
Hiruma

(10) Patent No.: US 7,654,634 B2
(45) Date of Patent: Feb. 2, 2010

(54) IMAGE FORMING METHOD AND APPARATUS WITH INTERLOCKING INKJET PRINTING OPERATIONS

(75) Inventor: Tetsuya Hiruma, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 476 days.

(21) Appl. No.: 11/492,457

(22) Filed: Jul. 24, 2006

(65) Prior Publication Data

US 2007/0019029 A1 Jan. 25, 2007

(30) Foreign Application Priority Data

Jul. 25, 2005 (JP) ..... 2005-214891

(51) Int. Cl.
*B41J 2/165* (2006.01)

(52) U.S. Cl. ..... 347/29; 347/32

(58) Field of Classification Search ..... 347/29, 347/32, 37, 33

See application file for complete search history.

(56) References Cited

U.S. PATENT DOCUMENTS 5,757,395 A * 5/1998 Chew et al. ..... 347/24
5,774,139 A * 6/1998 Salzer et al. ..... 347/32
6,000,779 A * 12/1999 Ng et al. ..... 347/24
6,132,026 A * 10/2000 Taylor et al. ..... 347/32
6,220,692 B1 * 4/2001 Iwaya et al. ..... 347/33
6,318,835 B2 * 11/2001 Nakahara ..... 347/30
6,334,663 B1 * 1/2002 Lee ..... 347/33
6,554,393 B2 * 4/2003 Iwaya et al. ..... 347/33
6,568,789 B2 * 5/2003 Lin et al. ..... 347/33

FOREIGN PATENT DOCUMENTS

JP 9-69899 11/1997
JP 2000-85156 3/2000

* cited by examiner

*Primary Examiner*—Stephen D Meier
*Assistant Examiner*—Rene Garcia, Jr.
(74) *Attorney, Agent, or Firm*—Cooper & Dunham, LLP

(57) ABSTRACT

An image forming apparatus that has a carriage with a recording head having a nozzle for ejecting an ink includes a capping member configured to cover the nozzle of the recording head, a locking member configured to lock the carriage at a predetermined position, and an interlocking mechanism configured to perform one of locking and unlocking the carriage with the locking member according to one operation of contacting and separating the nozzle with the capping member.

12 Claims, 9 Drawing Sheets

IMAGE FORMING METHOD AND APPARATUS WITH INTERLOCKING INKJET PRINTING OPERATIONS

TECHNICAL FIELD

The present disclosure relates to a method and apparatus for image forming, more particularly relates to an image forming apparatus including a print head maintenance mechanism in which inkjet printing operations are interlocked, and a method of interlocking the inkjet printing operations performed in the image forming apparatus.

BACKGROUND

There exists serial-type image forming apparatuses, in which an inkjet print head mounted on a carriage moves relative to and ejects recording fluid or ink from a nozzle, which is formed on the inkjet print head, toward a recording medium so as to form an image on a surface of the recording medium including a recording sheet, transfer material or any kind of recording material. While the recording sheet, for example, is conveyed at predetermined intervals according to a recording width of the recording sheet, the carriage reciprocally moves in a direction perpendicular to the direction to which the recording sheet is conveyed and the inkjet print head ejects liquid droplets of ink from the nozzle toward the recording sheet. By repeating the conveyance of the recording sheet and the travel of the carriage, an image may be formed or printed on the recording sheet.

Some inkjet print heads are prone to defects due to viscosity-increased ink. To maintain and refresh the ability and condition of the inkjet print heads and clean the nozzles formed on the inkjet print heads, a maintenance unit is required to correct the defects.

The maintenance unit generally includes a capping member for tightly covering a nozzle mounted surface of the inkjet print head and preventing an increase of viscosity of ink around a nozzle formed on the inkjet print head, and another capping member for removing and purging the viscosity-increased ink from the nozzle. These capping members may be formed in one capping member having both of a moisturizing function and a purging function. The maintenance unit further includes a wiping member, such as a wiping blade, a cleaning blade, a wiper, a blade member, a blade or so forth, for wiping and removing the ink adhered to the nozzle mounted surface, and a dummy ejection receiver for purged ink that is not used for image forming or becomes defective.

When the carriage is moved while the capping member covers the nozzle mounted surface, the position of the capping member may change and become unstable. The unstable capping condition may increase the speed of developing viscose ink to clog the nozzle, which can cause ink ejection defect.

Further, the capping member may physically damage the sealing portion of the nozzle mounted surface, which can cause a suction defect due to a leakage of ink from the nozzle.

To avoid the above-described conditions, a carriage locking member may be included in an image forming apparatus so as to lock the carriage having the inkjet print head thereon to a predetermined position. With the above-described condition, the inkjet print head can reliably be kept to the predetermined position when the defective or unused ink is removed from the recording head while capping the nozzle mounted surface of the inkjet print head.

Further, to downsize the maintenance unit, the image forming apparatus in the background art may use a common driving source for the carriage locking member, the wiping member, and a suction pump for removing ink from the nozzle.

However, since the carriage locking member and the capping member are generally not mechanically interlocked or operated at the same time, the capping member needs another driving source that is different from the driving source for the carriage locking member, wiping member and suction pump. As a result, the maintenance unit may have increased size, operational complexity, and cost.

Further, when the capping member covers the nozzle mounted surface while the carriage locking member has not properly locked the carriage, the capping member cannot cover the proper area of the nozzle mounted surface. When the carriage is moved or the recording sheet is conveyed under this condition, the capping member may come off the nozzle mounted surface, and as a result the viscosity of ink in the nozzle can increase, the increased-viscosity may clog the nozzle and deterioration in image printing quality may occur.

In addition, the movement of the carriage while the capping member covers the improper area of the nozzle mounted surface can damage the capping member and prevent the proper ink removing operation.

SUMMARY

Some aspects of the present disclosure have been devised in view of the above-described circumstances.

In one aspect of the present disclosure, a novel image forming apparatus that can effectively interlock inkjet printing operations is provided.

In another aspect of the present disclosure, a method for interlocking printing operations by the above-described novel image forming apparatus is provided.

In one example, a novel image forming apparatus includes a capping member configured to cover the nozzle of the recording head, a locking member configured to lock the carriage at a predetermined position, and an interlocking mechanism configured to perform one of locking and unlocking the carriage with the locking member according to one operation of contacting and separating the nozzle with the capping member.

The novel image forming apparatus may further include a cap holder configured to hold the capping member. The cap holder may include a first engaging member configured to engage with the locking member.

The locking member may include a second engaging member configured to engage with the first engaging member in a direction to which the carriage is locked at the predetermined position, and a third engaging member configured to engage with the first engaging member in a direction to which the carriage is unlocked from the predetermined position.

The locking member may include a second engaging member configured to engage with the first engaging member in a direction to which the carriage is unlocked from the predetermined position.

The novel image forming apparatus may further include a biasing member configured to bias the locking member in a direction to which the carriage is locked at the predetermined position.

The first engaging member may be disengaged from the second engaging member while the capping member covers the nozzle of the recording head.

The novel image forming apparatus may further include a regulating member configured to regulate an amount of movement of the locking member with respect to the carriage.

The locking member may be held by a holding member, and the regulating member may be mounted on a side surface of the holding member.

Further, a novel method of interlocking printing operations, in one example, includes mounting a first engaging member on a cap holder used to perform locking and unlocking a carriage, mounting a second engaging member on a locking member used to perform contacting and separating a nozzle, engaging the first engaging member with the second engaging member, and performing one of locking and unlocking the carriage according to one of contacting and separating the nozzle.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF EMBODIMENTS AND EXAMPLES

Figure 1:
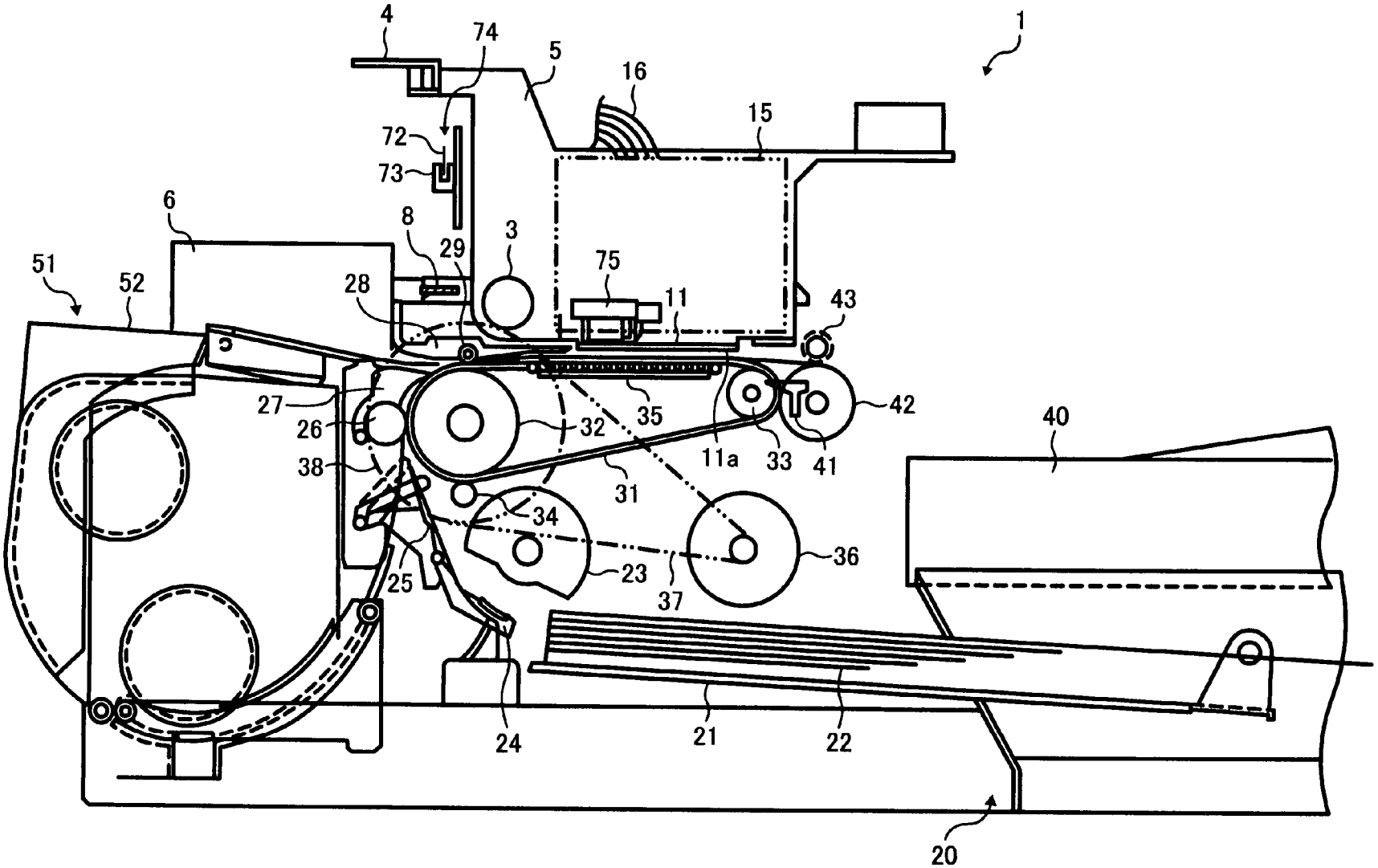
FIG. 1 is a schematic structure of an image forming apparatus according to an exemplary embodiment of the present disclosure.

In describing embodiments and examples in connection with the drawings, specific terminology is employed for the sake of clarity. However, the disclosure of this patent specification is not intended to be limited to the specific terminology so selected and it is to be understood that each specific element includes all technical equivalents that operate in a similar manner.

Referring now to the drawings, wherein like reference numerals designate identical or corresponding parts throughout the several views, preferred embodiments of the present disclosure are described.

Figure 2:
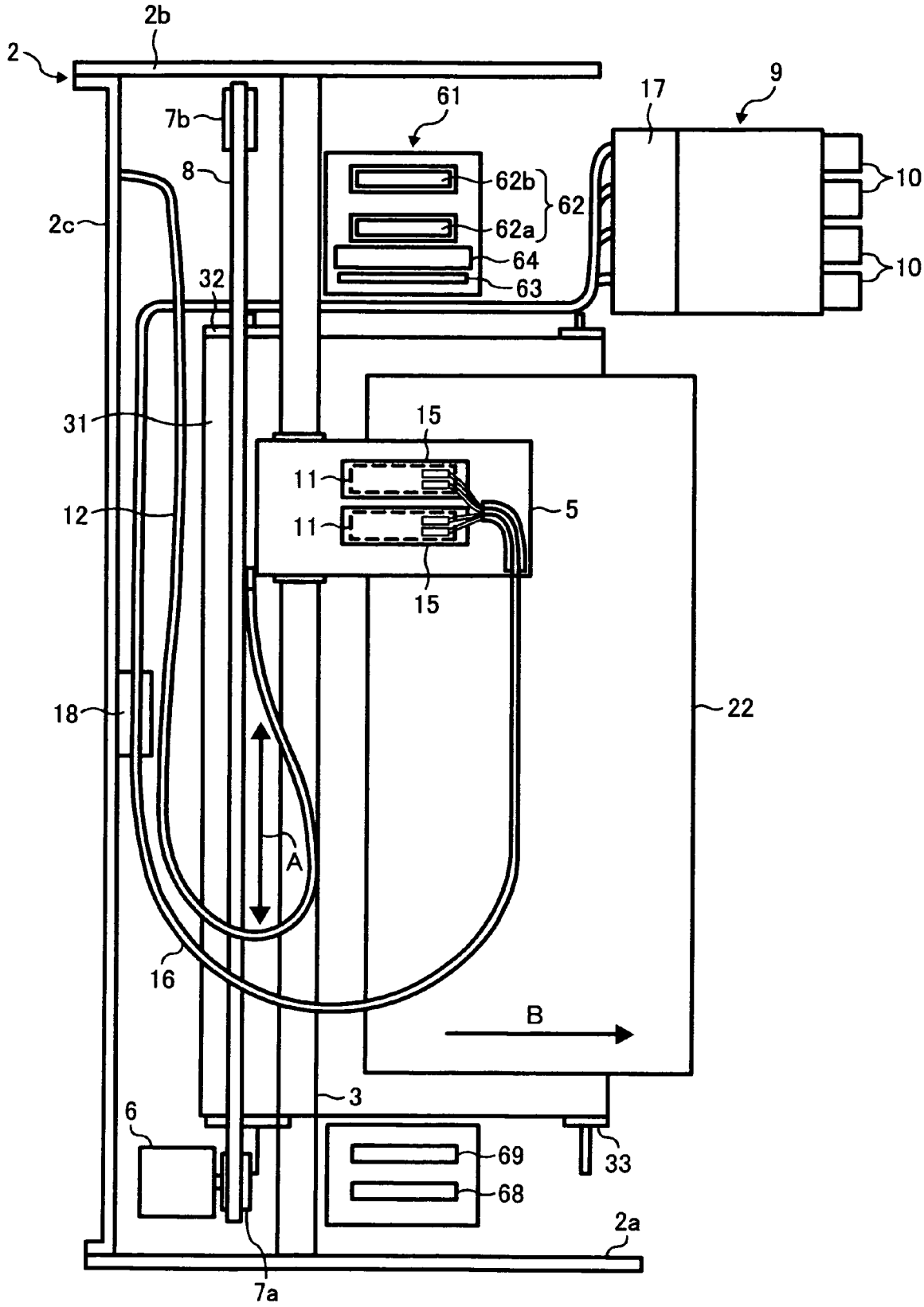
FIG. 2 is a top view of the image forming apparatus of FIG. 1.

Referring to FIGS. 1 and 2, a schematic structure of an image forming apparatus 1 according to an example of the present disclosure is described.

FIG. 1 is a cross sectional view of the image forming apparatus 1. FIG. 2 is a top plane view of the image forming apparatus 1.

The image forming apparatus 1 includes a frame 2 including side plates 2*a* and 2*b* and a rear plate 2*c*, a guide rod 3 serving as a guide member, a stay 4, a carriage 5, a main scanning direction motor 6, a driving pulley 7*a*, a driven pulley 7*b*, and a timing belt 8.

Both the guide rod 3 and the stay 4 are extended in parallel with the rear panel 2*c*, between the side plates 2*a* and 2*b*. One end of the guide rod 3 and one end of the stay 4 in the longitudinal direction are engaged with the side plate 2*a*, and the other end of the guide rod 3 and the other end of the stay 4 are engaged with the side plate 2*b*.

The guide rod 3 and the stay 4 hold the carriage 5 which is slidable in a main scanning direction of the image forming apparatus 1 or the longitudinal direction of the guide rod 3 and the stay 4, as indicated by arrow A in FIG. 2.

The carriage 5 is driven by the main scanning direction motor 6 and can slidably move in a reciprocating manner in the main scanning direction of the image forming apparatus 1, via the timing belt 8 extended between the driving pulley 7*a* and the driven pulley 7*b*.

The carriage 5 includes two liquid droplet ejection print heads or two print heads 11. The respective print heads 11 serving as a recording head eject droplets of ink of different colors, which are yellow (y), cyan (c), magenta (m), and black (bk). Each of the print heads 11 has a nozzle mounted surface 11*a* on which are provided a plurality of orifices or holes or nozzles from which ink droplets are ejected. The plurality of nozzles of a single color ink are aligned in a form of row or array and are arranged at the same pitch on the nozzle mounted surface 11*a* of each print head 11.

Hereinafter, the array of the plurality of nozzles is referred to as a "nozzle array", and the liquid droplet ejection print heads 11 are sometimes referred to as a "print head 11", expressing in a singular unit.

The nozzle array formed on the nozzle mounted surface 11*a* of the print head 11 is aligned in the sub-scanning direction that is the direction perpendicular to the main scanning direction. The print head 11 is mounted with the nozzle mounted surface 11*a* thereon and facing downward so that the ink can be ejected toward the recording sheet.

For example, one of the print heads 11 includes one nozzle array formed by a plurality of nozzles that eject yellow ink droplets and another nozzle array formed by a plurality of nozzles that eject magenta ink droplets, and the other of the print heads 11 includes one nozzle array formed by a plurality of nozzles that eject cyan ink droplets and another nozzle array formed by a plurality of nozzles that eject black ink droplets.

Alternatively, the image forming apparatus 1 can include four separate print heads having respective nozzle arrays of single colors or can include one print head having four nozzle arrays of different single colors.

In addition, the print head 11 of the present disclosure is not limited to the above-described structures. Each print head 11 of the image forming apparatus 1 of the present disclosure can eject two different single colors, therefore four colors in total. However, the number of colors of ink to be ejected can be any other number.

Further, each of the print heads 11 of the example corresponding to FIGS. 1 and 2 includes two nozzle arrays respectively. However, the print head 11 of the present disclosure can have any different number of nozzle arrays, and can eject any colors different from the above-described colors.

As an inkjet print head forming the print head 11, a pressure generator that exerts a pressure to eject ink droplets can be employed.

Examples of the inkjet heads are a piezoelectric actuator using piezoelectric elements, a thermal actuator using thermoelectric conversion elements by utilizing a phase change caused by liquid film boiling, a memory alloy actuator utilizing a phase change of metal caused by a temperature change, an electrostatic actuator using an electrostatic force, and so forth.

The print head 11 includes a driver IC (integrated circuit) therein, and is connected to a controller (not shown) via a harness (flexible print cable) 12.

The carriage 5 further includes respective sub tanks 15 of different colors of ink to be supplied to the print heads 11. The respective sub tanks 15 are supplied with ink of different colors via respective ink supplying tubes 16 from respective ink cartridges 10 mounted on a cartridge filling portion 9. The cartridge filling portion 9 includes an ink supplying pump unit 17 for delivering ink reserved in the respective ink cartridges 10. A portion of the ink supplying tube 16 is supported by an engaging member 18 that is mounted on the rear plate 2c of the frame 2.

The image forming apparatus 1 further includes a sheet feeding roller 23 formed in a shape of a half moon and a separation pad 24. The sheet feeding roller 23 and the separation pad 24 serve as a sheet feeding portion for feeding a recording sheet 22 stacked on a thick panel or a sheet stacking portion 21 of a sheet feeding tray 20.

The sheet feeding roller 23 separates the recording sheet 22 one by one from the recording media stacked on the sheet stacking portion 21.

The separation pad 24 includes a material having a great coefficient of friction and is disposed at a position facing the sheet feeding roller 23. The separation pad 24 is biased in the direction toward the sheet feeding roller 23.

The image forming apparatus 1 further includes a guide member 25, a counter roller 26, a conveyance guide member 27, a pressing member 28, and a conveying belt 31 so as to convey the recording sheet 22 fed from the sheet feeding portion and to deliver the recording sheet 22 to a position under the print head 11.

The guide member 25 guides the recording sheet 22 while the recording sheet 22 travels.

The pressing member 28 includes a leading portion pressing roller 29.

The conveying belt 31 serves as a sheet conveying unit to electrostatically attract the recording sheet 22 thereto and convey the recording sheet 22 to a position under the print head 11 so that the recording sheet 22 can face the print head 11.

The conveying belt 31 is an endless loop-shaped belt and is extended by or spanned around a conveying roller 32 and a tension roller 33. The conveying belt 31 travels in a sub-scanning direction or a belt moving direction while being charged by a charging roller 34.

The conveying belt 31 can have a single-layered structure or a multi-layered structure (having two or more layers).

When the conveying belt 31 has a single-layer structure, an insulating material may be employed for the entire layer thereof since the conveying belt 31 contacts the recording sheet 22 and the charging roller 34.

When the conveying belt 31 has a multi-layered structure, at least one layer contacting the recording sheet 22 and the charging roller 34 is preferably formed by an insulating material and the other layers are preferably formed by a conductive material.

Examples of the insulating material forming the insulating layer of the conveying belt 31 having the single- or multi-layer structure are preferably resins or elastomers not including a conductive material, for example, PET (polyethylene terephthalate), PEI (polyetherimide), PVDF (polyvinylidene fluoride), PC (polycarbonate), ETFE (tetra fluoroethylene), PTFE (polytetra fluoroethylene). The volume resistivity is equal to or greater than $10^{12}$ Ωcm, and is preferably $10^{15}$ Ωcm.

The material forming the conductive layer of the conveying belt 31 having the multi-layered structure preferably includes carbon into the above-described resins or elastomers. The volume resistivity thereof is preferably in the range from approximately $10^5$ Ωcm to approximately $10^7$ Ωcm.

When the conveying belt 31 has the multi-layer structure, the charging roller 34 contacts the insulating layer serving as the surface layer of the conveying belt 31. The charging roller 34 is so disposed that the charging roller 34 may be rotated following the rotations of the conveying belt 31, and both ends of the shaft of the charging roller 34 receive a pressure. The charging roller 34 includes a conductive member having a volume resistivity in a range from approximately $10^6$ Ω/square to approximately $10^9$ Ω/square. The charging roller 34 receives, for example, 2 kV of a positive and negative polarity AC bias (high voltage) applied from an AC (alternating current) bias supply (high voltage source), which will be described later. The AC bias can be a sine wave or a triangular wave, and is more preferably a square wave.

As shown in FIG. 1, a guide member 35 is disposed on the inner side of the conveying belt 31 in which the guide member 35 faces a printing area of the print head 11.

The upper surface of the guide member 35 is protruded toward the print head 11 from a tangent line defined by the conveying roller 32 and the tension roller 33.

Accordingly, the conveying belt 31 is pushed toward an upper direction by the upper surface of the guide member 35 at the printing area, and thereby a planarity of the conveying belt 31 at the printing area can be maintained with a higher precision.

A sub-scanning direction motor 36 rotates a conveying roller 32 via a driving belt 37 and a timing roller 38 so that the conveying belt 31 can rotate in a belt moving direction as shown in FIG. 2.

An encoder wheel (not shown) including a slit (not shown) is provided on the shaft of the conveying roller 32. A transmission photosensor (not shown) is also provided to detect the slit of the encoder wheel. The encoder wheel and the photosensor form a wheel encoder.

The sheet discharging portion of the image forming apparatus 1 includes a sheet discharging tray 40, a separation claw 41, and sheet discharging rollers 42 and 43.

The sheet discharging tray 40 is provided under the sheet discharging rollers 42 and 43.

The separation claw 41 separates the recording sheet 22 from the conveying belt 31.

The image forming apparatus 1 can further include a duplex printing unit 51 on a back side of the body of the image forming apparatus 1 as shown in FIG. 1, in which the duplex printing unit 51 is detachably attached to the body of the image forming apparatus 1.

The duplex printing unit 51 receives the recording sheet 22 from the conveying belt 31 when the conveying belt 31 travels in a direction opposite to the direction as indicated by arrow B in FIG. 2, and inverts faces of the recording sheet 22. Then the duplex printing unit 51 feeds the face-inverted recording sheet 22 to the space formed between the counter roller 26 and the conveying belt 31.

Furthermore, a manual sheet feeding tray 52 can be provided on the upper surface of the duplex printing unit 51.

As shown in FIG. 2, a print head maintenance unit 61 is provided on one end of the non-printing area of the image forming apparatus 1 (e.g., in the vicinity of the side plate 2*b*). The print head maintenance unit 61 is used to maintain and refresh the nozzle condition of the print head 11.

Figure 4:
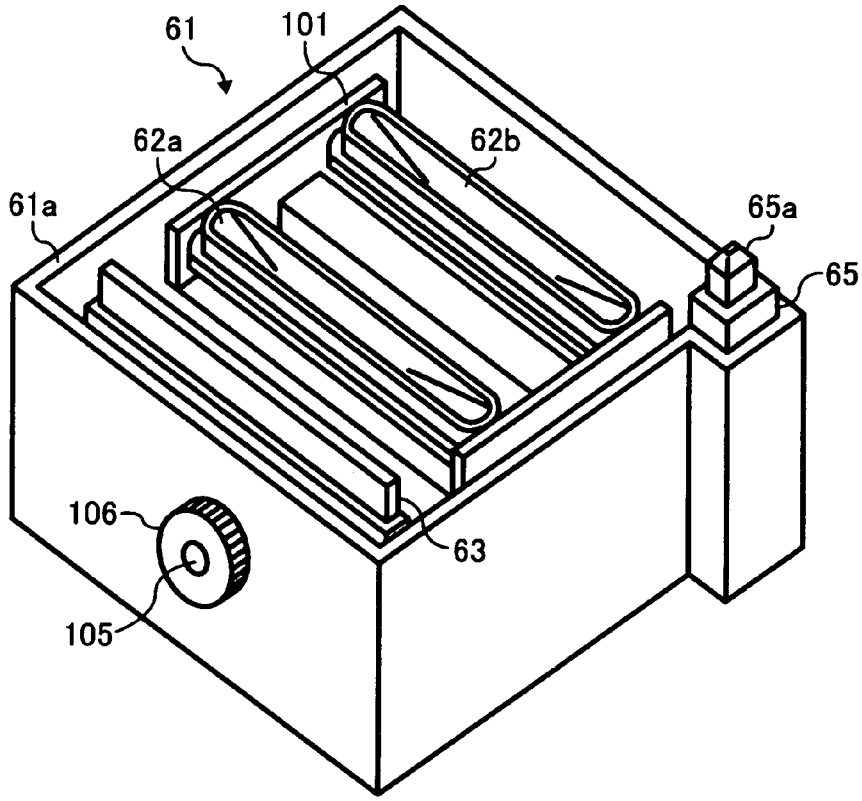
FIG. 4 is a perspective view of the print head maintenance mechanism of FIG. 3.

The print head maintenance unit 61 includes capping members 62*a* and 62*b*, a wiping blade 63, a first dummy ejection receiver 64, and a carriage locking member 65 (see FIG. 4).

The capping members 62*a* and 62*b* are used for capping the nozzle mounted surface 11*a* of/the print head 11. The capping members 62*a* and 62*b* are sometimes referred to as a capping member 62 as a single unit.

The wiping blade 63 wipes the nozzle mounted surface 11*a*.

The first dummy ejection receiver 64 is used for receiving droplets when a dummy ink purging operation is performed. In the dummy ink purging operation, fresh ink is discharged from the nozzle without performing an actual printing operation, by which viscosity-increased ink on the nozzle can be removed.

The carriage locking member 65 is used to fix or lock the carriage 5 to a predetermined position, or a home position in this case.

A second dummy ejection receiver 68 is provided on the other end of the non-printing area of the image forming apparatus 1 (e.g., in the vicinity of the side plate 2*a*).

The second dummy ejection receiver 68 is used for receiving droplets when a dummy ink purging operation from the nozzle is performed during the actual printing operation. During the actual printing operation, the recording ink may increase its viscosity, and thereby such a dummy ink purging operation may be performed to purge such viscosity-increased ink from the nozzle to the second dummy ejection receiver 68. The second dummy ejection receiver 68 includes an opening 69, which is aligned to the nozzle array direction of the print head 11.

As shown in FIG. 1, a linear encoder 74 including an encoder scale 72 and an encoder sensor 73 is provided at a position in the vicinity of the carriage 5 along the main scanning direction of the carriage 5.

The encoder scale 72 has a slit thereon, and the encoder sensor 73 serving as a transmission photosensor detects the slit of the encoder scale 72. With the functions of the encoder scale 72 and the encoder sensor 73, the linear encoder 74 can detect the position of the carriage 5 in the main scanning direction.

A sheet sensor 75 is also provided on the side surface of the carriage 5 and faces the printing area thereof. The sheet sensor 75 determines whether the recording sheet 22 conveyed by the conveying belt 31 exists within the printing area.

In the image forming apparatus 1, the recording sheet 22 is fed one by one from the sheet feeding portion and conveyed in the vertical direction toward the printing area. Then, the recording sheet 22 is guided by the guide member 25, and transported to the space between the counter roller 26 and the conveying belt 31. After the recording sheet 22 is guided by a conveyance guide member 27, the leading edge of the recording sheet 22 is pressed to the conveying belt 31 by a leading portion pressing roller 29, by which the traveling direction of the recording sheet 22 is changed by approximately 90 degrees.

During such sheet transportation, the AC bias supply source (not shown) supplies a positive voltage and negative voltage charge to the charging roller 34. Therefore, the conveying belt 31 is alternately charged with positive voltage and negative voltage, thereby positive voltage charged areas and negative voltage charged areas are formed on the conveying belt 31 alternately.

When the recording sheet 22 is fed on such charged conveying belt 31, the recording sheet 22 is electrostatically adhered on the conveying belt 31, and is transported to the printing area with a traveling of the conveying belt 31 in the sub-scanning direction.

While the carriage 5 is moved in the direction indicated by arrow A in FIG. 2, the print heads 11 are activated according to image signals. With the above-described operation, the transportation of the recording sheet 22 is stopped when ink droplets are ejected to record one line image on the recording sheet 22.

When the recording or printing operation of one line image completes, the recording sheet 22 is conveyed by a predetermined length and another one line image is recorded or printed on the recording sheet 22 by ejecting ink droplets onto the recording sheet 22. Such recording or printing operation is repeated for one page.

When the above-described recording operation completes for one page, a recording end signal or a signal informing the trailing edge of the recording sheet 22 has reached the recording area is issued. When one of the above-described signals is received, the recording sheet 22 is discharged to the sheet discharging tray 40.

During the duplex printing operation, the conveying belt 31 moves in the reverse direction when the recording sheet 22 completes recording or printing an image on a front surface, on which a first image is printed. The recording sheet 22 having the first image thereon is conveyed into the duplex printing unit 51. Then, the recording sheet 22 is inverted so as to print a second image on the back side of the recording sheet 22. Then, the recording sheet 22 is conveyed to the space between the counter roller 26 and the conveying belt 31. After the printing timing has been controlled, the recording sheet 22 is, as previously described, conveyed by the conveying belt 31, receives the second image thereon, and is discharged to the sheet discharging tray 40.

During a standby mode of the image forming apparatus 1, at which the recording operation is not performed, the carriage 5 is moved over the print head maintenance unit 61. During such standby mode, the capping members 62*a* and 62*b* cap the print heads 11 to maintain the nozzle in a wet or moist condition. By capping or covering the recording head 11 with the capping member 62, an ink purging malfunction caused by clogged nozzle can be prevented.

Further, a refreshing operation such as purging of viscosity-increased ink and gas bubble from the nozzle can be performed by suctioning the ink from the nozzle while capping the printing head 11 with the capping member 62.

Further, a dummy ink purging operation, in which ink is purged from the nozzle while actual printing operation is not performed, can be performed before starting the printing operation or during the printing operation. With such dummy ink purging operation, the ejection-ability of the print head 11 can be maintained at a stable level.

Referring to FIGS. 3 through 6, a configuration of the print head maintenance unit 61 is described.

Figure 3:
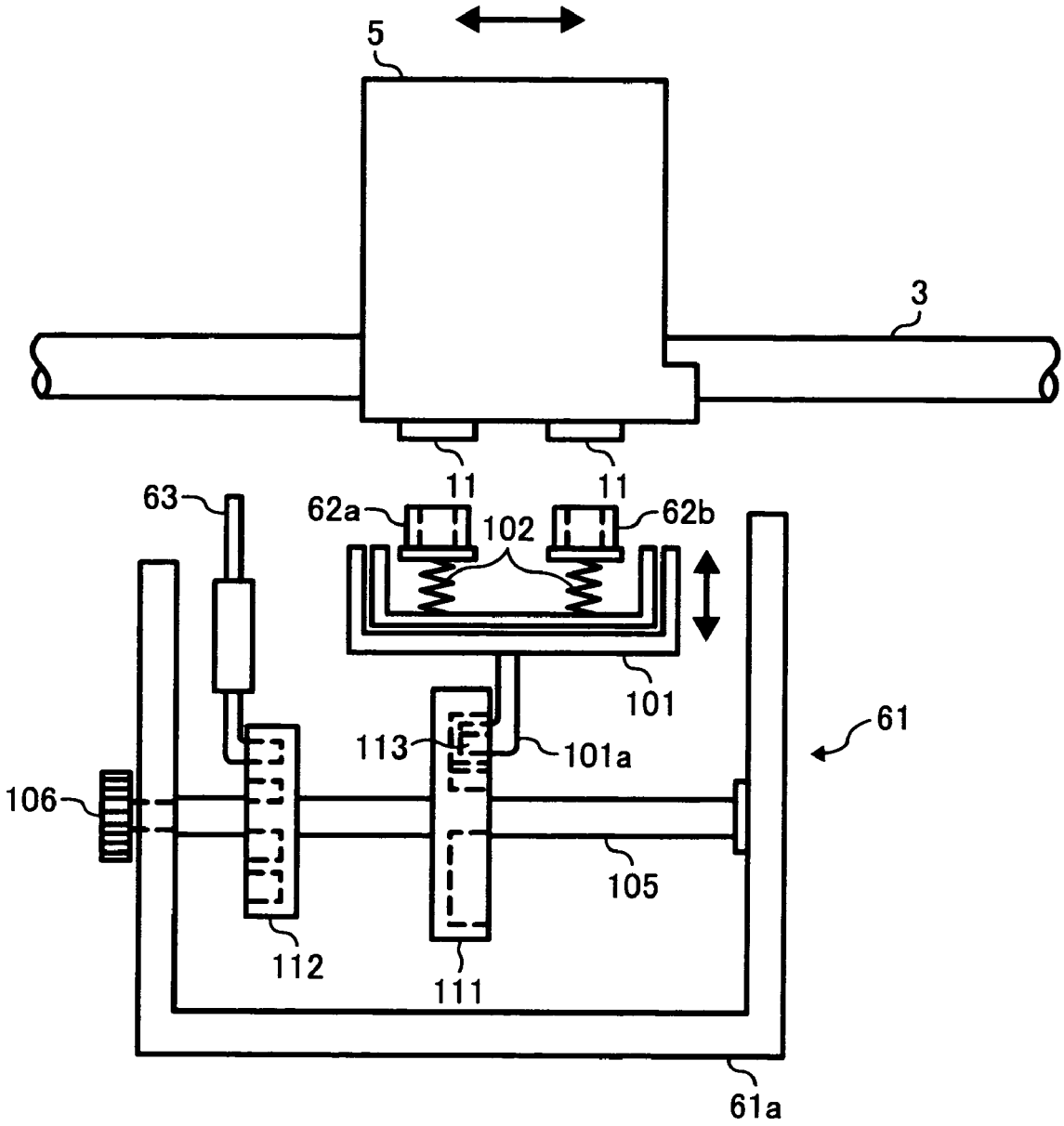
FIG. 3 is a front view of a print head maintenance mechanism, according to the exemplary embodiment, in the image forming apparatus of FIG. 1.
Figure 5:
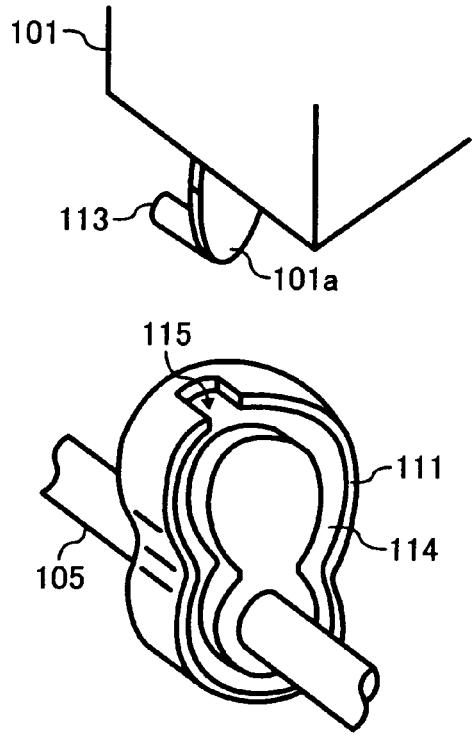
FIG. 5 is a perspective view of an elevation mechanism of a capping member included in the print head maintenance mechanism of FIG. 3.
Figure 6:
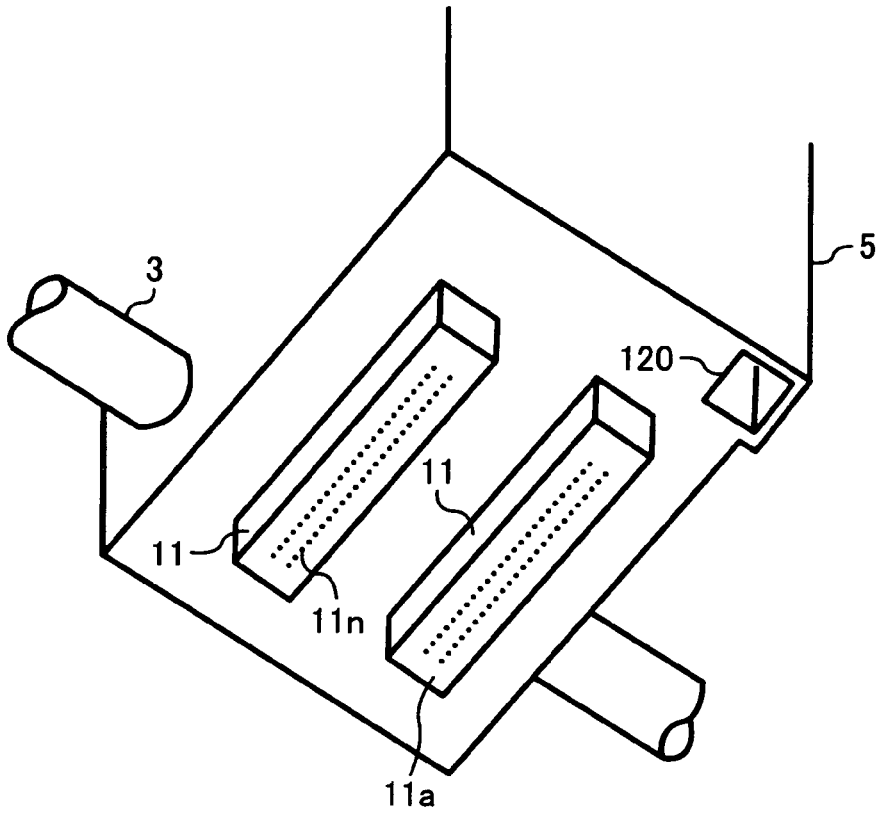
FIG. 6 is a perspective view of a carriage included in the print head maintenance mechanism of FIG. 3.

FIG. 3 is a front view of the print head maintenance unit 61. FIG. 4 is a perspective view of the print head maintenance unit 61. FIG. 5 is a perspective view of an elevation mechanism of the capping member 62 of the print head maintenance unit 61. FIG. 6 is a perspective view of the carriage 5.

The print head maintenance unit 61 includes a frame 61a, a cap holder 101, elastic members 102, a cam shaft 105, a gear 106, a cap cam 111, a wiper cam 112, and a boss 113.

The frame 61*a* of the print head maintenance unit 61 is a holding member that holds the cap holder 101, the wiping blade 63 including an elastic member, the first dummy ejection receiver 64 (see FIG. 2), and the carriage locking member 65 in a manner capable of elevating.

The cap holder 101 holds the capping members 62*a* and 62*b*.

The elastic members 102 are mounted between the cap holder 101 and the capping members 62*a* and 62*b* to bias or apply forces to pull the capping members 62*a* and 62*b* in the upward direction or a capping direction. When the capping members 62*a* and 62*b* are in contact with the respective nozzle mounted surfaces 11*a* of the print heads 11, the elastic members 102 may shrink or go downward so as to closely contact the capping members 62*a* and 62*b* to the respective nozzle mounted surfaces 11*a*.

The cam shaft 105 is rotatably disposed below the cap holder 101, horizontally extending between the opposite side plates of the frame 61*a*.

The gear 106 is used to receive a force exerted by a drive motor (not shown) and to transmit the force to the cam shaft 105.

The cap cam 111 is mounted on the cam shaft 105 so as to elevate the cap holder 101.

The wiper cam 112 is also mounted on the cam shaft 105 so as to elevate the wiping blade 63.

As shown in FIGS. 3 and 5, a flange 101*a* is mounted on the bottom surface of the cap holder 101 and the boss 113 having a cylindrical shape is mounted on the flange 101*a*.

The cap cam 111 includes a cam groove 114 so that the boss 113 of the cap holder 101 can slidably be engaged with the cap cam 111. The rotation of the cam shaft 105 rotates the cap cam 111.

The rotation of the cap cam 111 can perform a contact and separation operation of the cap holder 101.

When the cap holder 101 elevates or moves upward with the capping members 62*a* and 62*b*, the capping members 62*a* and 62*b* come in contact with and cap or cover the respective nozzle mounted surfaces 11*a* of the print heads 11.

When the cap holder 101 descends or moves downward with the capping members 62*a* and 62*b*, the capping members 62*a* and- 62*b* separate from the nozzle mounted surfaces 11*a* of the print heads 11.

The cap cam 111 also includes a slit 115 that is used to insert the boss 113 of the cap holder 101 into the cam groove 114. The slit 115 is preferably formed at an upstream position in the rotational direction of the cap cam 111, which is a stop position of a top dead center or a capping position. The above-described position of the slit 115 is determined such that the position can decrease the amount of force of an elastic member of the carriage locking member 65.

The carriage 5 includes nozzle arrays 11*n* on each of the nozzle mounted surfaces 11*a* of the print heads 11, as shown in FIG. 6. The print head 11 is formed on the bottom surface of the carriage 5, on which a cavity 120 is formed.

The cavity 120 is used to be engaged with a leading portion 65a of the carriage locking member 65, which is shown in FIG. 4.

When the cap holder 101 of the print head maintenance unit 61 is elevated, the carriage locking member 65 also moves in the upward direction. When the leading edge 65*a* of the carriage locking member 65 is engaged with the cavity 120 of the carriage 5, the carriage 5 can be locked to the predetermined position or the home position.

When the cap holder 101 of the print head maintenance unit 61 comes down, the carriage locking member 65 also moves in the downward direction. When the leading edge 65*a* of the carriage locking member 65 is disengaged or separated from the cavity 120 of the carriage 5, the carriage 5 can be unlocked or released from the home position.

Figure 7:
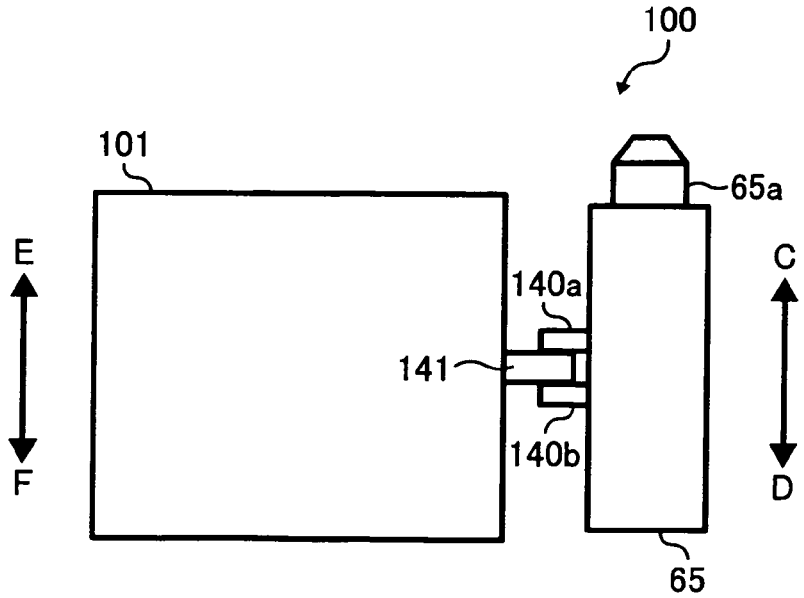
FIG. 7 is a cross sectional view of a first example of an interlocking mechanism according to the present disclosure.

Referring to FIG. 7, a schematic structure of an interlocking mechanism 100 according to a first exemplary embodiment of the present disclosure is described.

An interlocking mechanism, including the interlocking mechanism 100 according to the first exemplary embodiment, interlocks the contact and separation operations performed by the capping member 62 with respect to the nozzle mounted surface 11*a* of the print head 11 and the locking and unlocking operations performed by the carriage locking member 65.

In FIG. 7, the interlocking mechanism 100 includes the carriage locking member 65 having the leading portion 65*a*, the cap holder 101, protruding portions 140*a* and 140*b* formed on the side surface of the carriage locking member 65, and a protruding portion 141 formed on the side surface of the cap holder 101.

When the cap holder 101 is elevated in the direction indicated by arrow E, the protruding portion 141 thereof comes in contact or is engaged with the protruding portion 140*a* of the carriage locking member 65. Thereby, the carriage locking member 65 is elevated in the direction indicated by arrow C.

When the cap holder 101 is moved in the direction indicated by arrow F, the protruding portion 141 thereof can come in contact or engage with the protruding portion 140*b* of the carriage locking member 65. Thereby, the carriage locking member 65 is moved downward in the direction indicated by arrow D.

As described above, the cap holder 101 and the carriage locking member 65 are mechanically engaged or interlocked. That is, the contact and separation operations in which the cap holder 101 is in contact with or is separated from, respectively, the capping member 62 and the locking and unlocking operation in which the carriage locking member 65 locks or unlocks the carriage 5 to or from the home position thereof are interlocked.

Specifically, when the cap holder 101 is elevated in the direction E to contact and cover the nozzle mounted surface 11*a* of the print head 11, the carriage locking member 65 is mechanically interlocked and is moved in the direction C. The leading portion 65*a* of the carriage locking member 65 is then engaged with the cavity 120 of the carriage 5. Thus, the carriage 5 is locked to the home position.

Hereinafter, the direction C to which the carriage locking member 65 is moved to lock or fix the carriage 5 to the home position is referred to as a "locking direction."

At this time, if the carriage 5 is not properly positioned at the home position, which is the position in which the carriage locking member 65 can correctly be locked, the leading portion 65*a* of the carriage locking member 65 cannot be properly engaged with the cavity 120 of the carriage 5. Then, the cap holder 101 cannot be elevated further upward, which may prevent the capping member 62 from contacting the nozzle mounted surface 11*a* of the print head 11. Under the above-described condition, even if the position of the carriage 5 is moved and adjusted so as to properly engage the leading edge 65*a* of the carriage locking member 65 with the cavity 120, the capping member 62 may not contact the nozzle mounted surface 11*a* of the print head 11, and thus damage, such as scratching, to the nozzle mounted surface 11*a* caused by the capping member 62 can be reduced or even avoided.

When the cap holder 101 is moved in the direction F to release or separate the capping member 62 from the nozzle mounted surface 11*a* of the print head 11, the carriage locking member 65 mechanically interlocked with the movement of the cap holder 101 is also moved in the direction D. The above-described movement separates or releases the leading portion 65*a* of the carriage locking member 65 from the cavity 120 of the carriage 5. Thus, the carriage 5 becomes unlocked from the home position.

Hereinafter, the direction D to which the carriage locking member 65 is moved to unlock or release the carriage 5 from the home position is referred to as an "unlocking direction."

As described above, by interlocking the locking and unlocking operations performed by the carriage locking member 65 with the contact and separation operations performed by the capping member 62, the structure of the driving unit for the carriage locking member 65 may become more simple, which can downsize the print head maintenance unit 61.

At the same time, when the carriage 5 is placed at which the carriage locking member 65 cannot properly lock the carriage 5 to the home position, the carriage locking member 65 may stop the capping member 62 contacting with the nozzle mounted surface 11*a*. Thereby, damage to the capping member 62 can be reduced or prevented.

Figure 8:
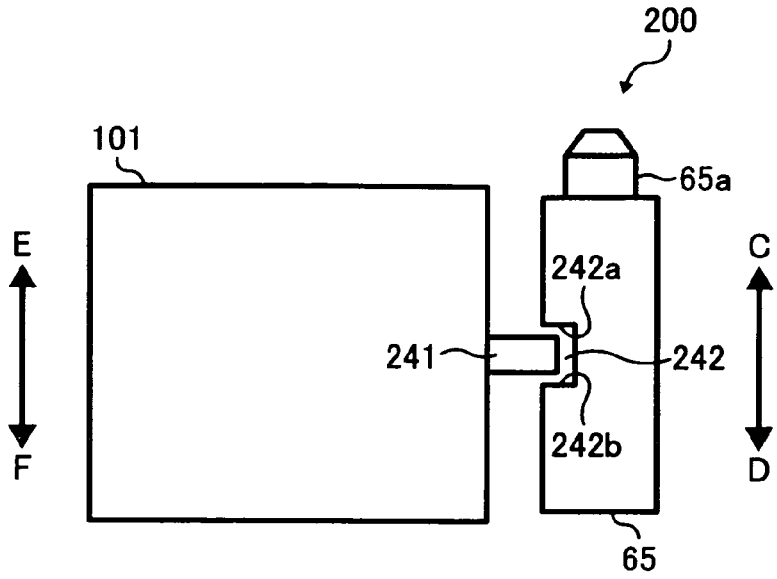
FIG. 8 is a cross sectional view of a second example of an interlocking mechanism according to the present disclosure.

Referring to FIG. 8, a schematic structure of an interlocking mechanism 200 according to a second exemplary embodiment is described.

As shown in FIG. 8, the interlocking mechanism 200 includes the carriage locking member 65 having the grooved portion 242 on the side thereof and the cap holder 101 having a protruding portion 241 on the side thereof. The grooved portion 242 formed on the carriage locking member 65 includes a top surface 242*a* and a bottom surface 242*b*.

When the cap holder 101 is elevated in the direction indicated by arrow E, the protruding portion 241 thereof comes in contact or engaged with the top surface 242*a* of the grooved portion 242 of the carriage locking member 65. Thereby, the carriage locking member 65 is moved in the direction C or in the locking direction.

When the cap holder 101 is moved in the direction F, the protruding portion 241 thereof comes in contact or engaged with the bottom surface 242*b* of the grooved portion 242 of the carriage locking member 65. Thereby, the carriage locking member 65 is moved in the direction D or in the unlocking direction.

That is, the movement of the carriage locking member 65 may be in synchronization with the movement of the cap holder 101, which can achieve the same effect obtained in the first exemplary embodiment.

Figure 9:
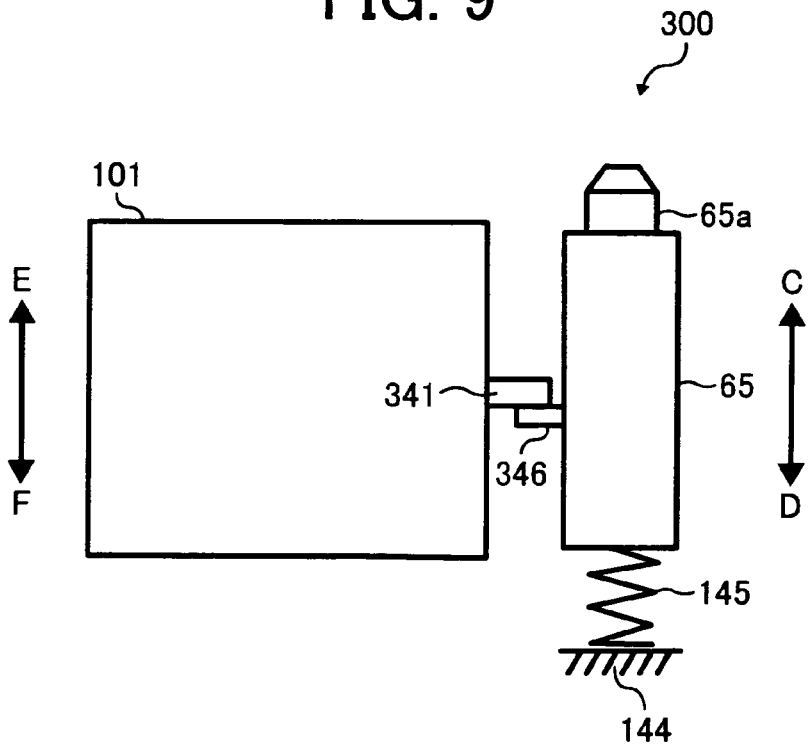
FIG. 9 is a cross sectional view of a third example of an interlocking mechanism according to the present disclosure.

Referring to FIG. 9, a schematic structure of an interlocking mechanism 300 according to a third exemplary embodiment is described.

As shown in FIG. 9, the interlocking mechanism 300 includes the carriage locking member 65 having the protruding portion 346 on the side thereof and the cap holder 101 having a protruding portion 341 on the side thereof.

In the interlocking mechanism 300, an elastic member 145 is provided between the carriage locking member 65 and a fixed portion 144.

The elastic member 145 serves as a biasing member such as a pressure spring or a rubber member and is used to bias or press the carriage locking member 65 in the upward direction or in the locking direction.

When the cap holder 101 is moved in the direction E to cause the capping member 62 to contact and cap the nozzle mounted surface 11*a* of the print head 11, the carriage locking member 65 is mechanically interlocked with the movement of the cap holder 101. The carriage locking member 65 is pushed upward by the restoring force exerted by the elastic member 145, and is moved in the direction C or in the locking direction.

Thus, the leading portion 65*a* of the carriage locking member 65 is engaged with the cavity 120 formed on the bottom surface of the carriage 5 so that the carriage 5 can be locked to the home position.

If the carriage 5 is not properly positioned at the home position, the leading portion 65*a* of the carriage locking member 65 cannot properly engage with the cavity 120 of the carriage 5. With the above-described condition, the cap holder 101 cannot go further upward, which may prevent the capping member 62 from contacting the nozzle mounted surface 11*a* of the print head 11. Under the above-described condition, even if the position of the carriage 5 is moved without the leading portion 65*a* of the carriage locking member 65 being engaged with the cavity 120 at the home position, damage, such as scratching, to the nozzle mounted surface 11*a* of the print head 11 caused by the capping member 62 can be avoided.

When the cap holder 101 is moved in the direction F to release or separate the capping member 62 from the nozzle mounted surface 11*a* of the print head 11, the protruding portion 341 formed on the cap holder 101 comes in contact with the protruding portion 346 formed on the carriage locking member 65. Thereby, the carriage locking member 65 may be moved in the direction D in synchronization with the movement of the cap holder 101. Thus, the leading portion 65*a* of the carriage locking member 65 is disengaged from the cavity 120, and the carriage 5 becomes unlocked from the home position.

As described above, according to the third exemplary embodiment (FIG. 9), both the cap holder 101 and the carriage locking member 65 include the respective protruding members 341 and 346 as engaging members that engage in the unlocking direction of the carriage 5. Further, the elastic member 145 is provided as a biasing member that biases the carriage locking member 65 in the locking direction of the carriage 5. With the above-described structure, the carriage locking member 65 can be assembled or can fit more easily.

In the interlocking mechanism 100 according to the first exemplary embodiment, the carriage locking member 65 and the capping member 62 are constantly engaged with each other. With the above-described structure, it is preferable that the carriage locking member 65 and the capping member 62 be mounted together to the frame 61*a* of the print head maintenance unit 61.

However, the above-described way of assembling the carriage locking member 65 and the capping member 62 may take a longer period for assembling to avoid errors in setting.

In the interlocking mechanism 300 according to the third exemplary embodiment, the carriage locking member 65 can be fitted to the frame 61*a* of the print head maintenance unit 61 before mounting the capping member 62. Thus, the structure according to the third exemplary embodiment can contribute to easier assembly, shorter operation period, and more stability.

Figure 10:
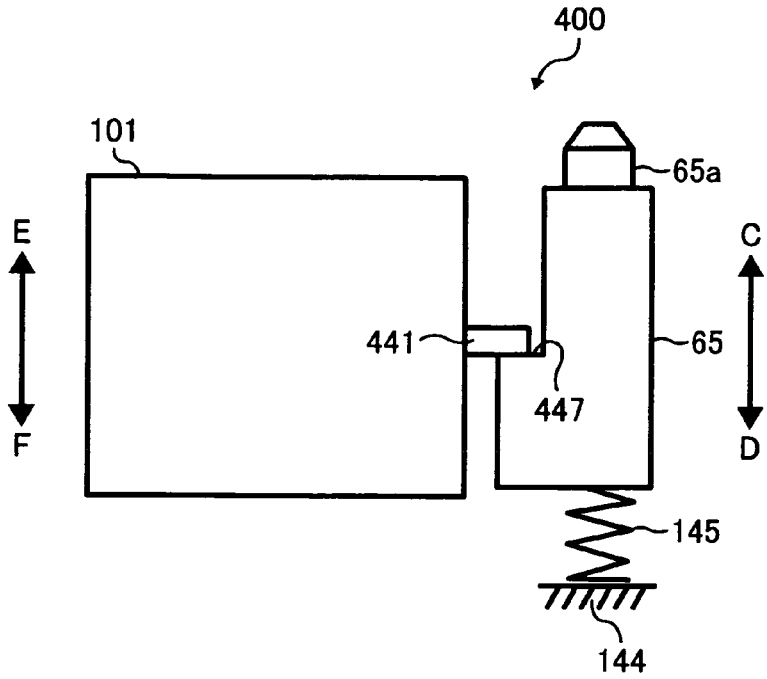
FIG. 10 is a cross sectional view of a fourth example of an interlocking mechanism according to the present disclosure.

Referring to FIG. 10, a schematic structure of an interlocking mechanism 400 according to a fourth example is described.

As shown in FIG. 10, the interlocking mechanism 400 includes the cap holder 101 having a protruding portion 441 on the side thereof and the carriage locking member 65 having the step portion 447 on the side thereof.

The step portion 447 of the carriage locking member 65 can be engaged with the protruding portion 441 of the cap holder 101 when the cap holder 101 is moved downward in the direction F, so that the carriage locking member 65 can be moved in the unlocking direction.

Similar to the interlocking mechanism 300 according to the third exemplary embodiment, the interlocking mechanism 400 includes the elastic member 145 provided between the carriage locking member 65 and the fixed portion 144 so that the elastic member 145 can bias or push the carriage locking member 65 in the direction C or in the locking direction of the carriage 5.

When the cap holder 101 is moved in the direction E to cause the capping member 62 to contact and cap the nozzle mounted surface 11*a* of the print head 11, the carriage locking member 65 is mechanically interlocked with the movement of the cap holder 101. The carriage locking member 65 is pushed by the restoring force exerted by the elastic member 145, and is moved in the direction C in the locking direction. The leading portion 65*a* of the carriage locking member 65 is then engaged with the cavity 120 formed on the bottom surface of the carriage 5. Thus, the carriage is locked to the home position.

When the cap holder 101 is moved in the direction F to release or separate the capping member 62 from the nozzle mounted surface 11*a* of the print head 11, the carriage locking member 65 mechanically interlocked with movement of the cap holder 101 is also moved in the direction D or in the unlocking direction. The above-described movement separates or releases the leading portion 65*a* of the carriage locking member 65 from the cavity 120 of the carriage 5. Thus, the carriage 5 becomes unlocked from the home position.

Figure 11:
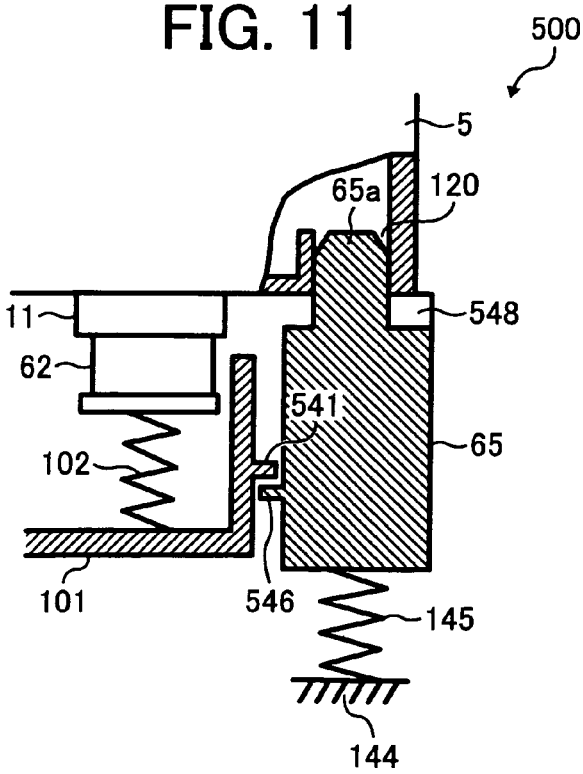
FIG. 11 is a cross sectional view of a fifth example of an interlocking mechanism according to the present disclosure.
Figure 12:
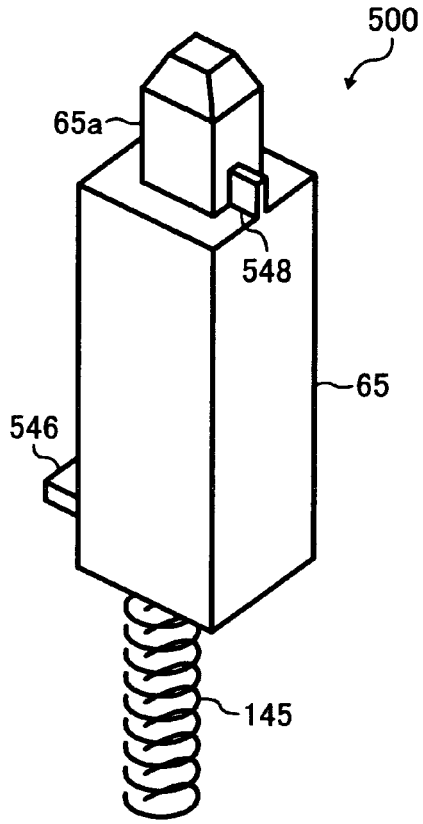
FIG. 12 is a perspective view of the interlocking mechanism shown in FIG. 11, including a carriage locking member.

Referring to FIGS. 11 and 12, a schematic structure of an interlocking mechanism 500 according to a fifth example is described.

FIG. 11 is a cross sectional view of the interlocking mechanism 500 according to the fifth example. FIG. 12 is a perspective view of the carriage locking member 65 according to the fifth example.

As shown in FIGS. 11 and 12, the interlocking mechanism 500 includes a protruding portion 548 at the leading portion 65*a* of the carriage locking member 65. The protruding portion 548 serves as a regulating member that regulates the amount of movement of the carriage locking member 65 toward the locking direction. Specifically, the protruding portion 548 is formed on a part of the leading portion 65*a* of the carriage locking member 65 and regulates the amount of depth or movement of the leading portion 65*a* of the carriage locking member 65 for engaging with the cavity 120 or the amount of distance of the leading portion 65*a* of the carriage locking member 65 in the cavity 120.

With the above-described structure, the cap holder 101 is moved upward or in the direction for the capping member 62 to contact with the nozzle mounted surface 11*a* of the print head 11. When the capping member 62 comes in contact with the nozzle mounted surface 11*a* of the print head 11, the elastic member 102 may retract or compress to pull the cap holder 101 in the upward direction so that the capping member 62 can closely cover or seal the nozzle mounted surface 11*a*.

With the above-described operation, the leading portion 65*a* of the carriage locking member 65 can be engaged with the cavity 120 formed on the carriage 5 to lock the carriage 5 to the home position. However, the protruding portion 548 formed on the leading portion 65*a* of the carriage locking member 65 may regulate the amount of depth or movement of the leading portion 65*a* of the carriage locking member 65 in the cavity 120 for engaging the leading portion 65*a* of the carriage locking member 65 with the cavity 120 on the carriage 5. Therefore, as shown in FIG. 11, the protruding portion 541 formed on the side surface of the cap holder 101 and the protruding portion 546 formed on the carriage locking member 65 cannot be in contact with each other, and the contact and separation operations and the locking and unlocking operations are not interlocked.

Thus, while the capping member 62 is in contact with the nozzle mounted surface 11*a* of the print head 11, the cap holder 101 and the carriage locking member 65 remain disengaged. Thereby, the biasing force exerted by the elastic member 145 is regulated not to affect the capping member 62 via the protruding portions 541 and 546 serving as the engaging members and the cap holder 101.

In the third embodiment (FIG. 9), the biasing force exerted by the elastic member 145 biases or applies the force to the carriage locking member 65 in the locking direction. Thereby, the protruding portion 341 of the cap holder 101 is constantly held in contact with the protruding portion 346 of the carriage locking member 65. Accordingly, the cap holder 101 constantly receives the biasing force exerted by the elastic member 145, thereby the cap holder 101 may be unstable in covering the capping member 62 when contacting the nozzle mounted surface 11*a* of the print head 11. As a result, there is a possibility the covering or sealing ability of the capping member 62 deteriorates and the ink in the nozzle becomes viscous. If these capping defects occur, then defects in suction and/or ejection of ink may be caused.

In the fifth example, by regulating the amount of engagement of the carriage locking member 65 with respect to the carriage 5, while the nozzle mounted surface 11*a* is covered by the capping member 62, the biasing force biasing the carriage locking member 65 may not be transmitted to the capping member 62 via the cap holder 101. Thereby, the capping defect can be reduced or prevented.

Figure 13:
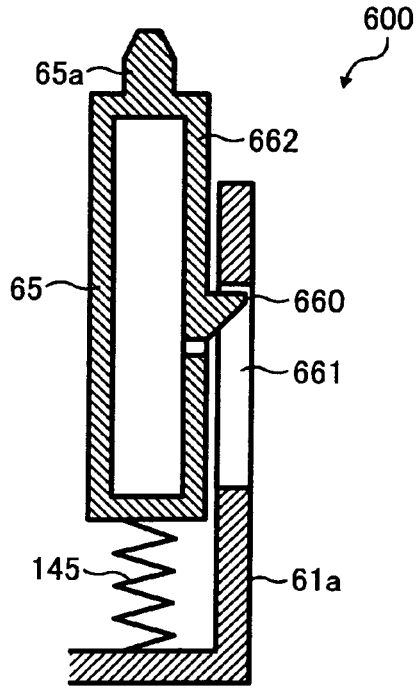
FIG. 13 is a cross sectional view of a sixth example of an interlocking mechanism according to the present disclosure.
Figure 14:
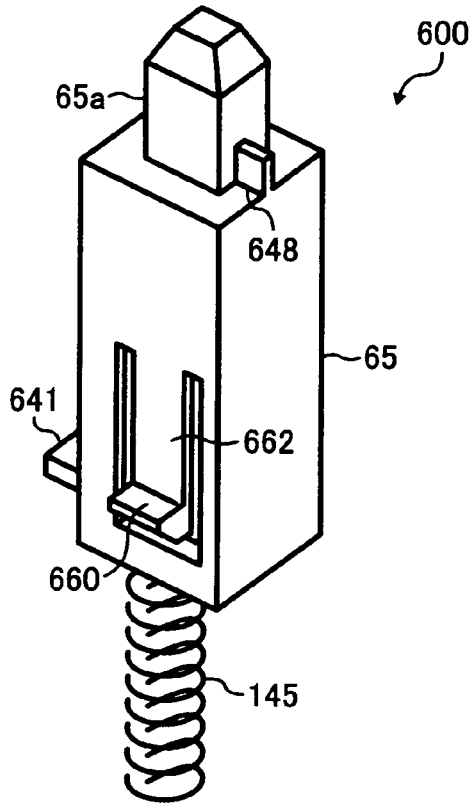
FIG. 14 is a perspective view of the interlocking mechanism shown in FIG. 13, including a carriage locking member.

Referring to FIGS. 13 and 14, a schematic structure of an interlocking mechanism 600 according to a sixth example is described.

FIG. 13 is a cross sectional view of the interlocking mechanism 600 according to the sixth example. FIG. 14 is a perspective view of the carriage locking member 65 according to the sixth example.

The carriage locking member 65 of the sixth example includes an elastic tongue piece 662 and a concave portion 661.

The elastic tongue piece 662 is mounted on the side surface of the carriage locking member 65 and includes a protruding portion 660 at the bottom end portion thereof.

The concave portion 661 is formed on the side surface of the frame 61*a* of the print head maintenance unit 61 so that the protruding portion 660 of the elastic tongue piece 662 can slidably move in the concave portion 661 in the vertical direction. The protruding portion 660 is formed in a retaining manner so as not to leave from the concave portion 661 on the frame 61*a*.

The protruding portion 660 and the concave portion 661 form a regulating member to regulate the amount of movement of the leading portion 65*a* of the carriage locking member 65 in the locking direction with respect to the carriage 5.

Accordingly, when the carriage locking member 65 is moved upward in synchronization with the elevation of the cap holder 101, the protruding portion 660 of the carriage locking member 65 contacts the top surface of the concave portion 661 of the frame 61*a,* by which the carriage locking member 65 may be stopped.

Similar to the interlocking mechanism 500 according to the fifth example, the leading portion 65*a* of the carriage locking member 65 according to the sixth example regulates the amount of depth or movement of the leading portion 65*a* of the carriage locking member 65 for engaging with the cavity 120 or the amount of distance of the leading portion 65*a* of the carriage locking member in the cavity 120. Therefore, when the capping member 62 is in contact with the nozzle mounted surface 11*a,* the cap holder 101 and the carriage locking member 65 may be disengaged from each other.

In the interlocking mechanism 500 of the fifth example, when the carriage 5 is not at the home position, if the capping member 62 and/or the cap holder 101 are moved in the direction toward the nozzle mounted surface 11*a,* the biasing force exerted by the elastic member 145 may cause the boss 113 (see FIGS. 3 and 5) of the cap holder 101 to separate from the slit 115 of the cap cam 111.

To avoid the above-described condition, a different member may be included to prevent the deviation of the boss 113. Therefore, the sixth example may regulate the amount of movement of the carriage locking member 65 by using the concave portion 661 of the frame 61*a,* and the cap holder 101 can be prevented from being released from the cap cam 111, which may need lower cost.

In the above-described case, as previously described, the slit 115 is preferably formed at an upstream position of the rotation of the cap cam 111, which is a stop position of a top dead center or a capping position. The above-described position of the slit 115 is determined such that the position can decrease the amount of the force of an elastic member of the carriage locking member 65.

Figure 15:
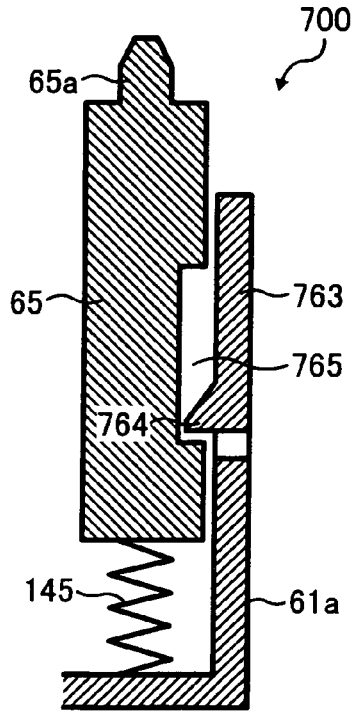
FIG. 15 is a cross sectional view of a seventh example of an interlocking mechanism according to the present disclosure.

Referring to FIG. 15, a schematic structure of an interlocking mechanism 700 according to a seventh example is described.

FIG. 15 is a cross sectional view of the interlocking mechanism 700 of the seventh example.

The print head maintenance unit 61 of the seventh example includes a protruding portion 764 at the bottom end portion of a flexible tongue piece 763 mounted on the side surface of the frame 61*a* thereof. The carriage locking member 65 includes a concave portion 765 on the side surface thereof so that the protruding portion 764 can slidably move in the concave portion 765. The protruding portion 764 of the frame 61*a* is formed in a retaining manner so as not to leave from the concave portion 765 of the carriage locking member 65.

With the above-described structure, the contact of the protruding portion 764 and the top surface of the concave portion 765 may regulate the amount of depth or movement of the leading portion 65*a* of the carriage locking member 65 in the locking direction. Therefore, the cap holder 101 can be prevented from being released from the cap cam 111 due to the biasing force exerted by the elastic member 145.

In the above-described exemplary embodiments and examples, the carriage locking member 65 is driven in synchronization with the movement of the capping member 62 serving as a suction cap. However, some image forming apparatus having a plurality of print heads may have a single suction cap. In that case, the carriage locking member 65 can be interlocked with the movement of a moisturizing cap instead of a suction cap.

The above-described exemplary embodiments and examples are illustrative, and numerous additional modifications and variations are possible in light of the above teachings. For example, elements and/or features of different illustrative embodiments and examples herein may be combined with each other and/or substituted for each other within the scope of this disclosure and appended claims. It is therefore to be understood that within the scope of the appended claims, the disclosure of this patent specification may be practiced otherwise than as specifically described herein.

Obviously, numerous modifications and variations of the present disclosure are possible in light of the above teachings. It is therefore to be understood that within the scope of the appended claims, the subject matter of the claims may be practiced otherwise than as specifically described herein.

This application claims priority from Japanese patent application No. 2005-214891 filed on Jul. 25, 2005 in the Japan Patent Office, the entire contents of which is hereby incorporated by reference herein.

What is claimed is:

1. An image forming apparatus having a carriage with a recording head having a nozzle for ejecting an ink, comprising:

a capping member configured to cover the nozzle of the recording head;

a locking member configured to lock the carriage at a predetermined position;

an interlocking mechanism configured to perform at least one of locking and unlocking the carriage with the locking member according to a corresponding one of an operation of contacting the nozzle with the capping member and an operation of separating the capping member from the nozzle;

a cap holder configured to hold the capping member, the cap holder comprising a first engaging member configured to engage with the locking member; and a biasing member configured to bias the locking member in a direction which causes the carriage to be locked at the predetermined position, wherein the locking member comprises a second engaging member configured to engage with the first engaging member in a direction which causes the carriage to be unlocked from the predetermined position, and the first engaging member is disengaged from the second engaging member while the capping member covers the nozzle of the recording head.

2. The image forming apparatus according to claim 1, further comprising:

a regulating member configured to regulate an amount of movement of the locking member with respect to the carriage.

3. The image forming apparatus according to claim 2, wherein:

the locking member is held by a holding member, and the regulating member is mounted on a side surface of the holding member.

4. The image forming apparatus according to claim 2, wherein the regulating member is formed on a side surface of the locking member.

5. The image forming apparatus of claim 1, wherein the first engaging member is configured to engage with the locking member in one of a first direction which causes the carriage to be locked at the predetermined position and a second direction which causes the carriage to be unlocked from the predetermined position.

6. The image forming apparatus of claim 1, wherein the carriage is configured to block the locking member from locking the carriage if the carriage is not at the predetermined position and the locking member is configured to prevent the capping member from contacting the nozzle if the carriage is not locked at the predetermined position.

7. The image fanning apparatus of claim 1 wherein the first engaging member includes an engagement surface for engaging the locking member, the engagement surface being oriented generally orthogonally to the nozzle contacting direction.

8. The image forming apparatus of claim 1, wherein the locking member is configured to lock the carriage before the capping member contacts the nozzle.

9. The image forming apparatus of claim 1 wherein the locking member is configured to unlock the carriage after the capping member is separated from the nozzle.

10. The image forming apparatus of claim 1, wherein the first engaging member is formed on a side surface of the cap holder, the side surface of the cap holder being oriented generally parallel to a nozzle contacting direction.

11. An image forming apparatus having a carriage with a recording head having a nozzle for ejecting an ink, comprising:

capping means for covering the nozzle of the recording head;

locking means for locking the carriage at a predetermined position; and interlocking means for performing at least one of locking and unlocking the carriage with the locking means according to a corresponding one of an operation of contacting the nozzle with the capping means and an operation of separating the capping means from the nozzle; and a cap holder configured to hold the capping means, the cap holder comprising a first engaging member configured to engage with the locking means, wherein the locking means comprises a second engaging member configured to engage with the first engaging member in a direction which causes the carriage to be unlocked from the predetermined position, and the first engaging member is disengaged from the second engaging member while the capping means covers the nozzle of the recording head.

12. A method for interlocking printing operations, comprising:

mounting a first engaging member on a cap holder to perform locking and unlocking a carriage;

mounting a second engaging member on a locking member to perform contacting and separating a nozzle;

engaging the first engaging member with the second engaging member;

disengaging the first engaging member from the second engaging member while a capping member held by the cap holder covers the nozzle of the recording head; and performing one of locking and unlocking the carriage according to one of contacting and separating the nozzle.

* * * * *